US005727741A

United States Patent [19]

Gibson

[11] Patent Number: 5,727,741

[45] Date of Patent: Mar. 17, 1998

[54] PULVERIZING ASSEMBLY

[75] Inventor: James L. Gibson, Fairhope, Ala.

[73] Assignee: Custom Machinery LLC, Shreveport, La.

[21] Appl. No.: 684,250

[22] Filed: Jul. 19, 1996

[51] Int. Cl.[6] ..... B02C 13/16; B02C 13/28

[52] U.S. Cl. ..... 241/157; 241/189.1; 241/194

[58] Field of Search ..... 241/79.3, 181, 241/188.1, 194, 154, 189.1

[56] References Cited

U.S. PATENT DOCUMENTS

| | | | |
|---|---|---|---|
| 266,781 | 10/1882 | Dell | 241/79.3 X |
| 306,544 | 10/1884 | Sottiaux | 241/188.1 X |
| 440,537 | 11/1890 | Boyd et al. | 241/194 |
| 647,531 | 4/1900 | Seldner | 241/188.1 X |
| 1,151,876 | 8/1915 | Hawk | 241/188.1 X |
| 1,212,991 | 1/1917 | Newhouse | 241/194 |
| 2,575,380 | 11/1951 | Borton | 241/194 |
| 2,628,036 | 2/1953 | Hall | 241/194 X |
| 3,696,817 | 10/1972 | Bonner, Jr. et al. | 241/154 X |
| 4,140,281 | 2/1979 | Fulghum, Jr. et al. | 241/28 |
| 4,166,583 | 9/1979 | Ruckstuhl | 241/73 |
| 4,538,767 | 9/1985 | Pimley | 241/79.3 |
| 4,734,960 | 4/1988 | Bougard | 241/47 |

*Primary Examiner*—John M. Husar
*Attorney, Agent, or Firm*—Louis E. Marn

[57] ABSTRACT

There is disclosed a pulverizing assembly comprised of a pulverizing housing defining a pulverizing chamber having spaced-apart and vertically-disposed shafts rotatably disposed therein wherein flywheels are mounted on each shaft in spaced-apart relationship. Rod members are mounted between the flywheels and beater assembly is rotatably disposed on each of the rod members. Each beater assembly is formed of a tubular member having a channel of a diameter greater than the diameter of the corresponding rod member with an elongated and retangularly-shaped beater plate member mounted by arm members mounted to the tubular member wherein the beater plate member is parallelly-disposed and spaced-apart from the tubular member of each beater assembly.

11 Claims, 2 Drawing Sheets

PULVERIZING ASSEMBLY

BACKGROUND OF THE INVENTION

1. Field of the Invention

This invention relates to a particle size reduction, and more particularly, to a pulverizing assembly for the reduction of materials to fine sizes or powders.

2. Brief Description of the Prior Art

The disposal of drill cuttings has been a longstanding problem in the field of well drilling and this problem has recently received attention due to increased concern regarding the environment. Offshore drilling operations, in particular, are problematic because the transportation of the cuttings to a landfill or a shore-based processing system is required. Illustrative of the solutions to the problem is disclosed, for example, in U.S. Pat. Nos. 5,109,933 and 5,129,469 wherein the cuttings are mixed with a carrier liquid, such as water, the size of the cuttings are reduced in a pump having an impeller of a backward swept blade type to form a slurry of the particulate particles and carrier liquid for injection into a well for disposal.

Other types of pulverizing assemblies are described in the following patents: U.S. Pat. Nos. 310,940 to Gould; 315,064 to Pratt; 345,408 to Burdge; 359,630 to Pratt; 666,404 to Worcester; 2,049,920 to McNitt; 3,927,840 to Nash; 3,931,936 to Petrie et al.; and 4,947,906 to Schroeder.

In U.S. Pat. No. 5,400,977 to Hales, there is disclosed a pulverizing system which reduces the size of solid particulate material, such as drilling cuttings from a well bore and including a pair of interconnected cylindrical chambers wherein each chamber there is provided a rotatable shaft with a plurality of disc sets mounted on the shafts. The shafts are aligned in parallel relationship and operate in a counter-rotating manner. Each disc set includes mounted thrust guides in the form of a bar shaped member wherein when the shafts are rotated at high speed, the particles contact each other in particle/particle contacting relation to thereby effect particle size reduction.

OBJECTS OF THE INVENTION

It is an object of the present invention to provide an improved apparatus for pulverizing solids materials.

Another object of the present invention is to provide an improved apparatus for disposing of drill cuttings from a well bore in manner to permit reduction of size of the particulate solid materials in the drilling cutting sufficient to permit re-introduction of the thus reduced drill cuttings into the well bore.

A further object of the present invention is to provide an improved pulverizing assembly for reducing the size of solid particles.

A still further object of the present invention is to provide a pulverizing assembly which advantageously may be employed in the pulverizing agricultural products and various types of minerals.

SUMMARY OF THE INVENTION

These and other objects of the present invention are achieved by a pulverizing assembly comprised of a pulverizing housing defining a pulverizing chamber having vertically-disposed and spaced apart shaft rotatably disposed therein and wherein. flywheels are mounted on each shaft in spaced-apart relationship. Rod members are mounted between the flywheels with beater assemblies rotatably disposed on the rod members. Each beater assembly is formed of a tubular member having a channel of a diameter greater than the diameter of the corresponding rod member with an elongated rectangular-shaped beater plate member mounted by arm member mounted to the tubular member wherein the beater plate member is parallelly- disposed and spaced apart from the tubular member.

BRIEF DESCRIPTION OF THE DRAWINGS

Further objects and advantages of the present invention will become apparent from consideration of the detailed disclosure especially when taken with the accompanying drawings wherein.

DESCRIPTION OF THE PRESENT INVENTION

Figure 1:
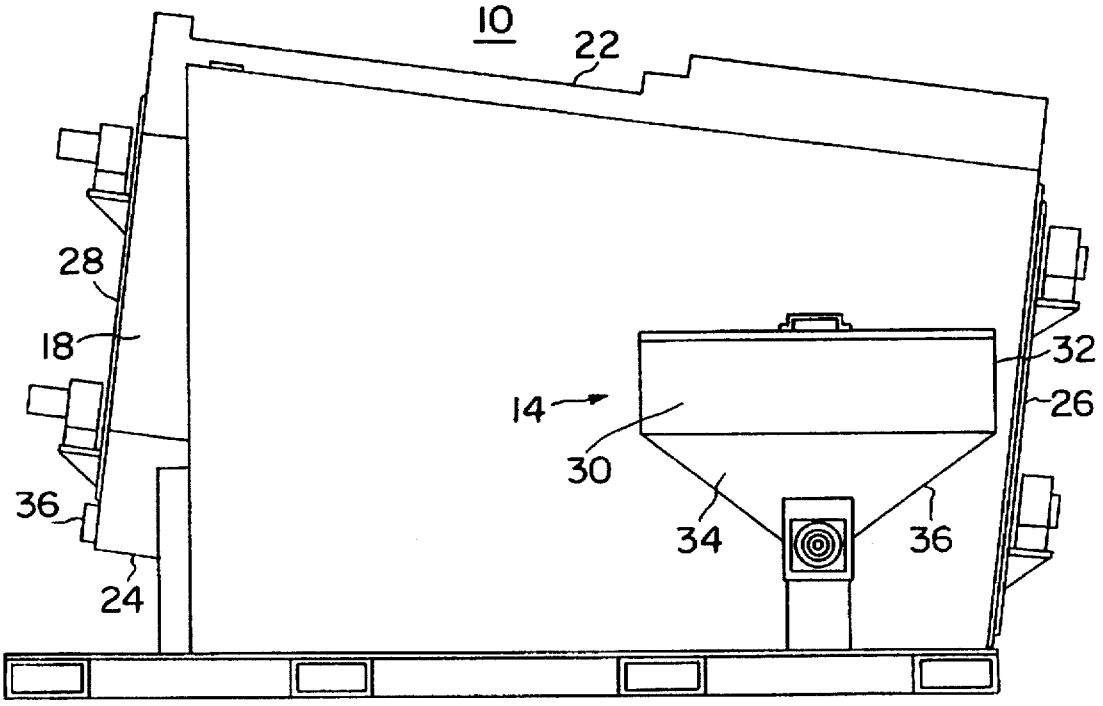
FIG. 1 is a side elevational view of the pulverizing assembly of the present invention.
Figure 2:
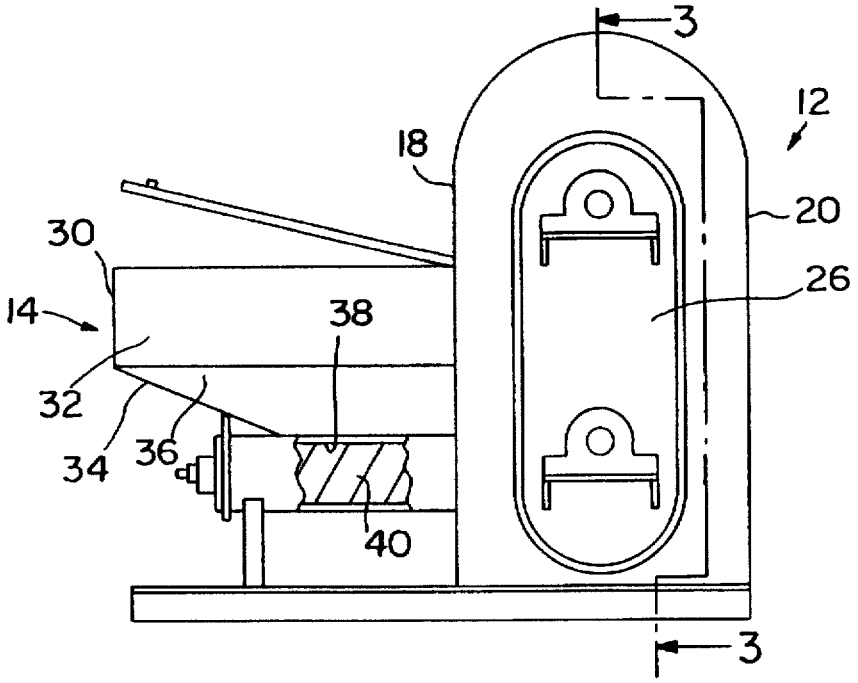
FIG. 2 is an end view of the pulverizing assembly of FIG. 1.
Figure 3:
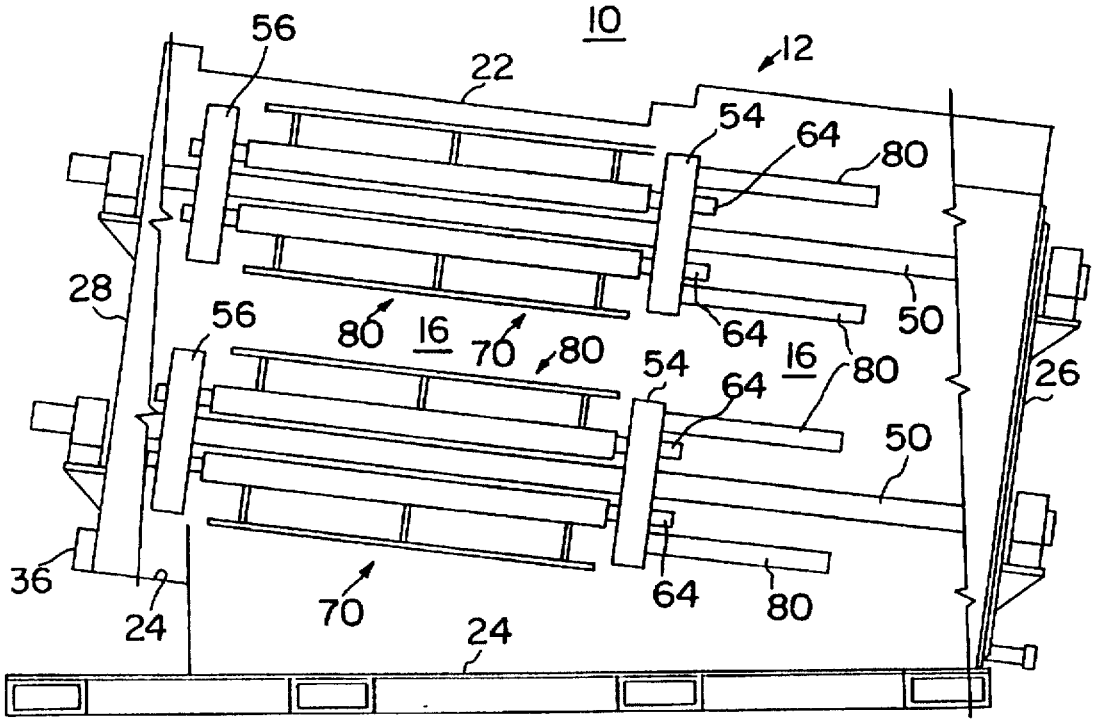
FIG. 3 is a sectional side view taken along the lines of 3—3 of FIG. 2.

Referring now to the drawings, and particularly to FIGS. 1 to 3, there is illustrated a pulverizing assembly, generally indicated as 10, comprised of a pulverizing vessel and a particulate feed assembly, generally indicated as 12 and 14. The pulverizing vessel 12 defines a pulverizing chamber 16 formed by parallelly disposed sidewalls 18 and 20, a cylindrically-shaped top wall 22, bottom wall 24 and end walls 26 and 28. The end wall 26 is provided with an outlet conduit 36 proximate the bottom wall 24, as more fully hereinafter described.

The particulate feed assembly 14 is generally a square-shaped hopper configuration, referring particularly to FIG. 2, comprised of upper wall member portions 30, 32 leading to frusto-conically shaped lower section formed by lower wall portions 34 and 36 leading to a chamber 38. An auger screw 40 is positioned within the chamber 38 leading to the pulverizing chamber 16.

Within the pulverizing chamber 16 of the pulverizing vessel 12, there is positioned spaced apart and vertically-disposed shaft members 50 mounted for rotation within suitable pillow block bearing supports 52 disposed outside the end walls 26 and 28 of the pulverizing vessel 12, referring particularly to FIG. 3. The shaft members 50 are mounted to respective motor assemblies, generally indicated as M, controlled through a separate control breaker panel (not shown).

Figure 4:
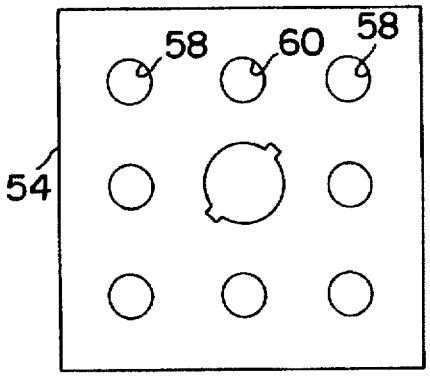
FIG. 4 is an elevational view of one flywheel assembly.
Figure 5:
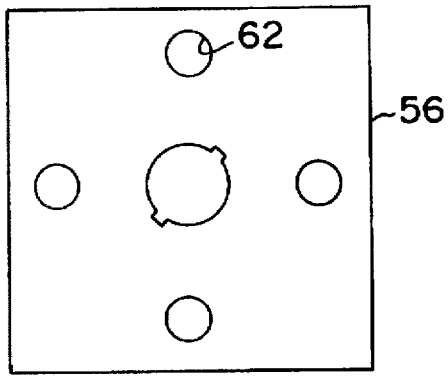
FIG. 5 is an elevational view of another flywheel assembly.

On each shaft 50, there are mounted a square-shaped flywheel member 54 and a square-shaped flywheel member 56 referring to FIGS. 4 and 5, respectively. The square-shaped flywheel member 54 are mounted intermediate the end walls 26 and 28 whereas the flywheels 56 are mounted proximate the end wall 28. Both the flywheels 54 and 56 are fixedly positioned on each shaft 50.

The square-shaped flywheel 54 is formed with threaded orifices 58 disposed at angles of 45°, 135°, 225° and 315° and smooth bore orifices 60 disposed at angles of 0°, 90°, 180° and 270° from the horizontal axis of the flywheel 54. The square-shaped flywheel 56 is provided with a plurality of smooth bore orifices 62 disposed at angles of 0°, 90°, 180° and 270° about the center line thereof and cooperate with the orifices 60 of the flywheel 54 as more fully hereinafter described.

Rod members 64 are positioned within the orifices 60 and 62 of the flywheel member 54 and 56, respectively.

Figure 6:
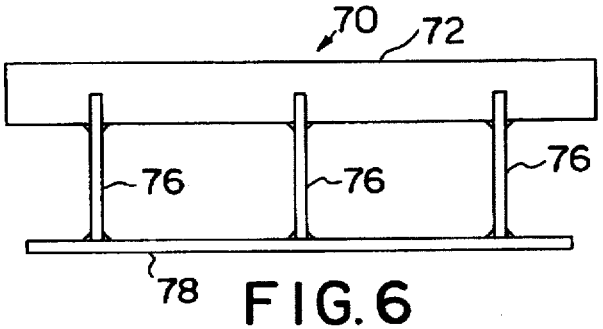
FIG. 6 is an elevational view, partially in section, of the beater assembly.
Figure 7:
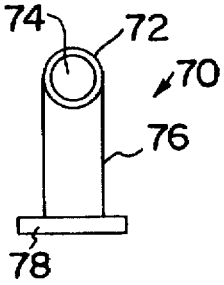
FIG. 7 is an end view of the beater assembly of FIG. 6.

On each rod member 64, there is disposed for rotation a beater assembly, generally indicated as 70, referring particularly to FIGS. 6 and 7. Each beater assembly 70 is formed of an elongated tube member 72 having a channel 74 of a diameter slightly greater than the outer diameter of the rod members 64. Extending perpendicularly and outwardly from the tube member 72, there is mounted, such as by welding, a plurality of arm members 76. An elongated rectangularly-shaped beater member 78 is mounted, such as by welding, to the ends of the arm members 76 in parallelly and spaced apart relationship to the elongated tube member 72.

The arm members 76 are generally of a rectangular shape to provide sufficient strength to maintain, in operation, the spatial integrity of the beater member 78 wherein the shafts 50 are caused to rotate at from 1000 to 1800 rpm's as a function of material being processed and desired mesh size of the final product.

Rod members 80 having a threaded end (not shown) are threaded into the intermediate flywheel 54 on a side thereof opposite the rod members 64 having beater members 70 rotatably mounted thereon.

The pulverizing assembly 110 is generally mounted in a support structure at an angle of about 15° from inlet end to outlet conduit to provide necessary dwell time for the material being processed, although the pulverizing assembly 10 may be mounted horizontally as understood by one skilled in the art.

In a static condition, the beater assemblies 70 are essentially vertically-disposed being rotatably mounted on the rod members 64.

In operation, as the shafts 50 gains rotational speeds, the beater assemblies 70 assume a radial disposition on the rod members 64 with the beater members 70 effecting particle size reduction together with the arm members 76 (to a lesser extent). Material being processed having a particle size up to 2.54–4.25 cm is introduced into the particulate feed assembly 14 and is passed by auger screw 40 into the pulverizing chamber 14 of the pulverizing assembly 10. Rotating rod members 80 effect a mixing action to prevent agglomeration in the feed end. As solids flow increases, there is solids build-up to the point where the material enters the pulverizing chamber 14 in which the beater assemblies are being rotated by rotation of the shafts 50. Particle size reduction in effect is at least about 40 mesh with product being withdrawn from the outlet conduit 36.

While the invention has been described in connection with the exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed:

1. A pulverizing assembly, which comprises:

a housing defining a chamber;

spaced-apart and vertically-disposed shafts rotatably disposed in said chamber;

spaced-apart flywheel members mounted on each of said shafts;

a plurality of parallelly-disposed rod members positioned between said flywheel members;

beater assembly including a tubular member disposed for rotation on said rod member, said beater assembly including a beater member spaced-apart from and parallelly-disposed to said tubular member;

inlet conduit means for introducing particular material for size reduction into said chamber;

outlet conduit means for removing sized reduced particulate material; and means for rotating said shafts.

2. The pulverizing assembly as defined in claim 1 wherein said beater member is an elongated rectangularly-shaped bar parallelly disposed to said tubular member.

3. The pulverizing assembly as defined in claim 1 wherein said beater member is mounted to arm members perpendicularly disposed to and mounted to said tubular member.

4. The pulverizing assembly as defined in claim 1 wherein said tubular member defines a channel of a diameter greater than an outer diameter of said rod members.

5. The pulverizing assembly as defined in claim 1 wherein said flywheels are rectangularly shaped.

6. The pulverizing assembly as defined in claim 1 wherein one of said flywheels is mounted on said shaft intermediate end walls of said housing.

7. The pulverizing assembly as defined in claim 6, and further including rod members threadedly mounted within threaded orifaces in said intermediate mounted flywheel and extending outwardly from said intermediate flywheel opposite said rod members on which said beater members are disposed.

8. The pulverizing assembly as defined in claim 1 wherein said motor means rotates said shaft at rotational speeds of from 1000 to 1800 rpm.

9. The pulverizing assembly as defined in claim 1 wherein ends of said shaft are mounted in pillow block bearings.

10. The pulverizing assembly as defined in claim 1 wherein said housing is angularly disposed to horizontal with said outlet conduit means being positioned above said inlet conduit means.

11. The pulverizing assembly as defined in claim 10 wherein said housing is disposed at an angle of 15° horizontal.

* * * * *